US006497137B2

(12) United States Patent
Helgeson

(10) Patent No.: US 6,497,137 B2
(45) Date of Patent: Dec. 24, 2002

(54) ANNULAR AFTER REACTOR WITH SOUND ATTENUATOR FOR USE IN A JET ENGINE TEST CELL AND TEST STAND

(75) Inventor: Norman Lewis Helgeson, Pacific Palisades, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 14 days.

(21) Appl. No.: 09/849,746

(22) Filed: May 7, 2001

(65) Prior Publication Data

US 2001/0029773 A1 Oct. 18, 2001

Related U.S. Application Data

(63) Continuation-in-part of application No. 09/436,715, filed on Nov. 8, 1999, now Pat. No. 6,237,395.

(51) Int. Cl.[7] ..... G01N 25/00

(52) U.S. Cl. ..... 73/23.31; 73/116; 73/117.1; 73/117.4; 73/865.6

(58) Field of Search ..... 73/23.31, 116, 73/117.1, 117.2, 117.3, 117.4, 865.6

(56) References Cited

U.S. PATENT DOCUMENTS

| | | | | |
|---|---|---|---|---|
| 4,372,110 A | | 2/1983 | Fletcher | 60/262 |
| 5,293,775 A | | 3/1994 | Clark et al. | 73/116 |
| 5,454,220 A | * | 10/1995 | Althaus et al. | 60/39.17 |
| 5,577,378 A | * | 11/1996 | Althaus et al. | 60/39.17 |
| 5,614,658 A | * | 3/1997 | Moss | 60/286 |
| 5,622,053 A | * | 4/1997 | Freen | 123/299 |
| 5,837,890 A | | 11/1998 | Long | 73/181 |
| 5,943,859 A | * | 8/1999 | Kawamura | 252/373 |
| 6,160,892 A | | 12/2000 | Ver | 381/71.5 |

* cited by examiner

*Primary Examiner*—Eric S. McCall
(74) *Attorney, Agent, or Firm*—David Kalmbaugh

(57) ABSTRACT

An annular after reactor is aligned axially with the direction of exhaust flow from the exhaust port of a jet engine under static test. Located near the front end of the reactor is a first set of gas injectors. A second set of gas injectors are located downstream from the first set of gas injectors within the reactor. The first set of gas injectors inject natural gas into the jet engine exhaust, while the second set of gas injectors inject ammonia into the jet engine exhaust. The natural gas when ignited raises the temperature of the jet engine exhaust which incinerates the particulate matter in the exhaust. Ammonia injected into the exhaust stream functions as a reductant to eliminate up to 90% of the $NO_X$ compounds in the exhaust stream. The reactor includes a jet engine exhaust buster assembly for substantially reducing noise generated by a jet's engine's exhaust.

23 Claims, 10 Drawing Sheets

ANNULAR AFTER REACTOR WITH SOUND ATTENUATOR FOR USE IN A JET ENGINE TEST CELL AND TEST STAND

This application is a continuation-in-part of U.S. patent application Ser. No. 09/436,715, filed Nov. 8, 1999 now U.S. Pat. No. 6,237,395.

BACKGROUND OF THE INVENTION

1. Field of the Invention

The present invention relates generally to apparatus for testing jet engines. In particular, the present invention relates to an annular after reactor (AAR) which is positioned in the exhaust of a jet engine under static test to remove particulate matter and other environmentally unsafe compounds from the exhaust of the jet engine and which includes a sound attenuator for substantially reducing noise associated with the testing of the engine.

2. Description of the Prior Art

The National Ambient Air Quality Standards established by the Clean Air Act requires the removal of fine particle concentrations from the atmosphere in an effort to decrease lung disease and related illnesses as well as mortality rates in urban areas. Currently, the standards have a criteria of PM10 (particles smaller than 10 microns in diameter, however, a standard for PM2.5 is in the process of being imposed. In addition, the Clean Air Act provides for the promulgation of national emission standards for engine test facilities including jet engine test cells.

The emissions of particulate matter, nitrogen oxides ($NO_X$), carbon monoxide and unburned hydrocarbons from the engine exhaust from a jet engine under test has been a concern of the military for two decades, however a cost effective approach for reduction of these environmentally harmful emissions remains to be identified.

Further, the problems that must be addressed to control these emissions are considerable, including the following: (1) the pollutant must be removed from large quantities of engine exhaust as well the augmentation air that accompanies and mixes with the exhaust; (2) the exhaust gases move at velocities of up to 3000 ft/sec and have temperatures of up to 3000 degrees Fahrenheit; (3) the operational conditions of jet engine test cells change frequently so that steady state operation is difficult to achieve; (4) proper test conditions require that only a limited back pressure be developed in the test cell augmentation tube; and (5) the cost for treatment of an exhaust stream from a jet engine is proportional to the total exhaust gas flow and inversely proportional to the pressure drop permitted.

One prior art approach provided for the use of water sprays to remove particulate matter from the jet engine exhaust stream. However, the approach led to the creation of acidic fallout near the jet engine test cell. In addition, the use of water sprays to remove PM2.5 particulates (i.e., particulates of a size less than 2.5 microns in diameter) is generally ineffective since particulates smaller than the order of 2.0 microns tend to follow streamlines around water droplets rather than be collected on them by impaction.

Other prior art approaches such as the use of a filter bed to remove particulate matter from jet engine exhausts have also been shown to be ineffective and costly.

In addition to the problems associated with the removal of particulate matter from jet exhaust, there is currently a need to substantially reduce the noise produced by the jet engines being tested in a static environment.

In the past, jet engine test cells and hush houses for testing jet engines in a static environment were dependent upon containment of the noise generated by the jet engine exhaust plume. Large structures and acoustic materials were used to absorb the acoustic energy. However, these structures are often very expensive and are generally insufficient for reducing to acceptable levels the noise generated by the static testing of jet engines.

Accordingly, there is a need for a relatively simple, cost effective and highly efficient apparatus for the removal of particulate matter and other environmentally harmful compound from the exhaust of a jet engine under test. Further, this apparatus needs to substantially reduce noise generated by the testing of a jet engine in a static environment.

SUMMARY OF THE INVENTION

The present invention overcomes some of the disadvantages of the prior art in that it comprises a relatively simple yet highly effective apparatus for removing particulate matter and other environmentally unsafe compounds from the exhaust of the jet engine being tested. In addition, the present invention includes apparatus for substantially reducing noise generated by a jet engine in a static environment such as a jet engine test cell.

An annular after reactor, comprising an embodiment of the present invention, is aligned axially with the direction of exhaust flow from the exhaust port of jet engine. Located near the front end of the annular after reactor is a first set of gas injectors which extend inward into the interior of the after reactor. A second set of gas injectors which are located downstream from the first set of gas injectors also extend inward into the interior of the after reactor. The first set of gas injectors inject natural gas (or other fuel) into the exhaust flowing from the jet engine, while the second set of gas injectors inject ammonia into the exhaust from the jet engine.

The natural gas, when ignited, substantially raises the temperature of the jet engine's exhaust to a temperature range of between 1850° F. to 2200° F. and causes the incineration of the particulate matter in the exhaust. Ammonia, when injected into the exhaust stream of the jet engine's exhaust, functions as a reductant to eliminate up to 90% of the $NO_X$ compounds in the exhaust stream.

The annular after reactor also includes a jet engine exhaust buster assembly for substantially reducing noise generated by a jet engine's exhaust from a jet engine under test in a static environment such as a jet engine test cell.

DETAILED DESCRIPTION OF THE PREFERRED EMBODIMENT

Figure 1:
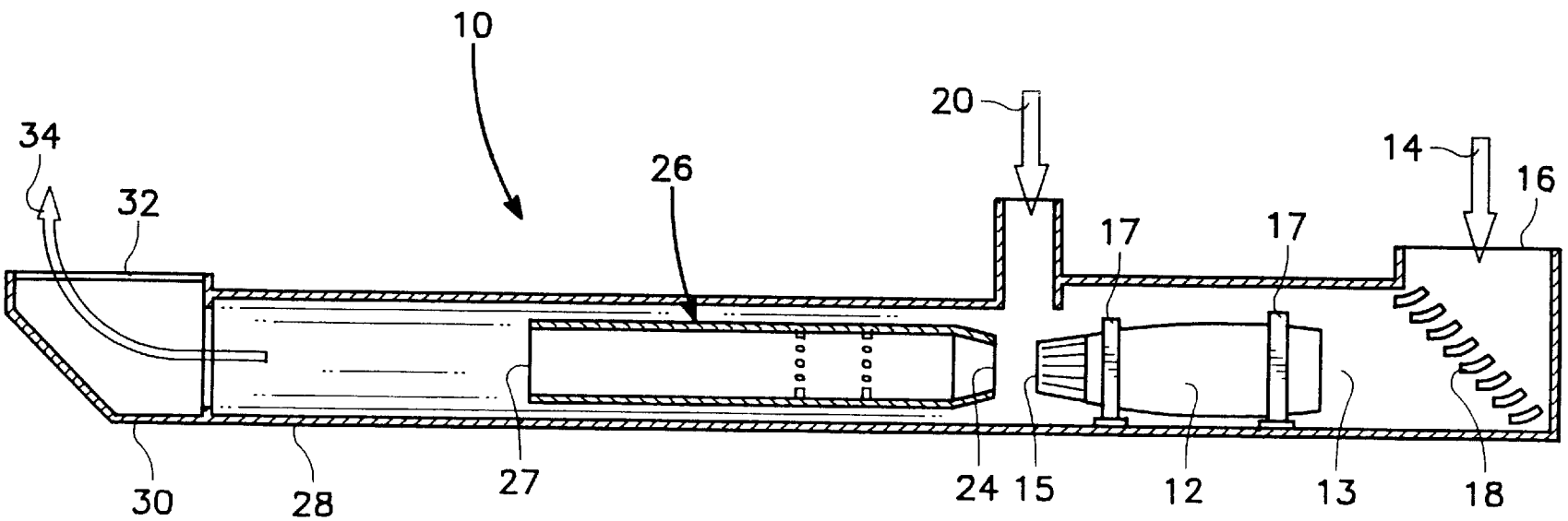
FIG. 1 is a plane side view of a jet engine test cell for testing a jet engine which includes the annular after reactor comprising the present invention.

Referring to FIG. 1 there is shown a jet engine test cell 10 which is used for testing a jet engine 12. The jet engine 12 under test emits particulate matter and other environmentally unsafe compounds such as NO, $NO_2$, CO and unburned hydrocarbons in its exhaust which must be removed from the exhaust prior to emitting the exhaust into the atmosphere.

Located in the forward portion of jet engine test cell 10 is a test chamber 13 which has the jet engine 12 under test mounted therein. A pair of straps 17 are used to secure jet engine 12 in a fixed position within test chamber 13. The front end of jet engine test cell 10 has a vertically positioned air intake port 16 which allows air to be drawn from the atmosphere into test chamber 13 (in the manner illustrated by arrow 14). Shaped louvers 18 positioned below air intake port 16 within test chamber 13 directs air drawn from the atmosphere toward the air intake of jet engine 12. Test chamber 13 of jet engine test cell 10 also has a vertically positioned air intake port 21 (FIG. 5) located within its rear portion which allows air from the atmosphere into chamber 13 at the exhaust port or exhaust nozzle 15 of jet engine 12. It should be noted that arrow 20 indicates the direction of flow of air from the atmosphere through air intake port 21 (FIG. 5) to the exhaust port 15 of jet engine 12.

Located in the forward portion of the augmenter tube 28 of jet engine test cell 10 is an annular after reactor 26 which removes particulate matter, nitrogen oxides, and unburned hydrocarbons, and hydrocarbons from engine exhaust from jet engine 12 which is under test. It should be noted that annular after reactor 26 is aligned axially with the direction of exhaust flow from the exhaust port 15 of jet engine 12.

Jet engine exhaust exiting outlet nozzle 27 of annular after reactor 26 flows through augmenter tube 28 to the exhaust stack 30 of jet engine test cell 10. The jet engine exhaust then exits test cell 10 through an outlet port 32 into the atmosphere (in the manner illustrated by arrow 34).

Figure 2:
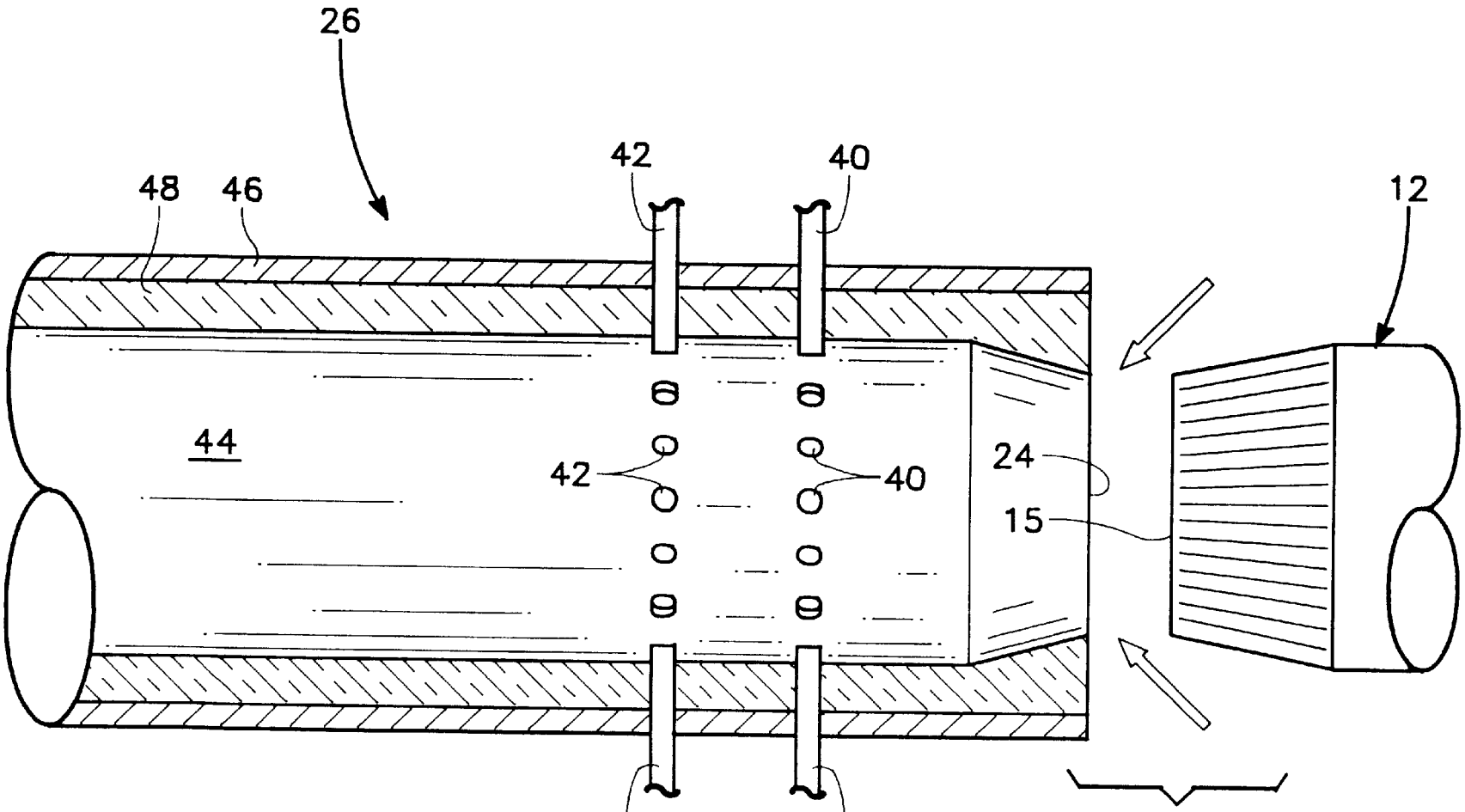
FIG. 2 is a plane view, in partial section, of the annular after reactor of FIG. 1.

Referring to FIGS. 1 and 2, there is shown a view, in partial section of the annular after reactor 26 which is an embodiment of the present invention. Annular after reactor 26, which is tubular in shape includes an outer casing 46 which is fabricated from steel pipe. Positioned inside of and affixed to casing 46 of after reactor 26 is a layer of ceramic material 48 which is also tubular in shape and provides a means for thermal protection. Thermal protection is required since the temperature from the jet engine's exhaust stream may range from about 460° F. for an idle jet engine to about 3000° F. for after burning.

The inlet 24 to annular after reactor 26 is shaped to function as a diffuser to reduce the velocity of jet exhaust exiting exhaust port of jet engine 12 as it enters annular after reactor 26. As the exhaust slows in the diffuser. the kinetic energy of the exhaust is recovered as pressure from the exhaust gases. This pressure is used to overcome the pressure losses within the after reactor and to reduce the back pressure developed in the after reactor 26 and in the augmenter tube 28.

There is also located near the front end of annular after reactor 26 a first set of spoke-like injectors 40 which are perpendicular to ceramic material 48 and extend inward into the interior 44 of reactor 26. A second set of spoke-like injectors 42 are located downstream from the first set of spoke-like injectors 40. Like injectors 40, injectors 42 are perpendicular to ceramic material 48 and extend inward into the interior 44 of reactor 26. Injectors 40 inject natural gas (or other fuel) into the exhaust flowing from jet engine 12, while injectors 42 inject $NH_3$ ammonia into the exhaust from jet engine 12.

The natural gas when ignited substantially raises the temperature of the jet engine's exhaust and causes the incineration of the particulate matter in the exhaust. Ammonia when injected into the exhaust stream for the jet engine's exhaust functions as a reductant to eliminate up to 90% of the nitrogen oxides $NO_X$ compounds in the exhaust stream. $NO_X$ compounds eliminated by ammonia include nitric oxide NO and nitrogen dioxide $NO_2$.

Referring to FIGS. 2 and 3A–3C, details of for a typical injector for annular after reactor 26 are shown which includes the temperature augmenter 26' (illustrated in FIGS. 3A–3C) for injecting natural gas into the jet engine's exhaust stream. Augmenter 26' includes a tubular injection ring 54 vertically positioned within the interior 44 of annular after reactor 26. A pair of fuel feed lines 56 and 58 are connected to injection ring 54 to supply natural gas to injection ring 54 and also to provides the support structure for injection ring 54.

Figure 3A:
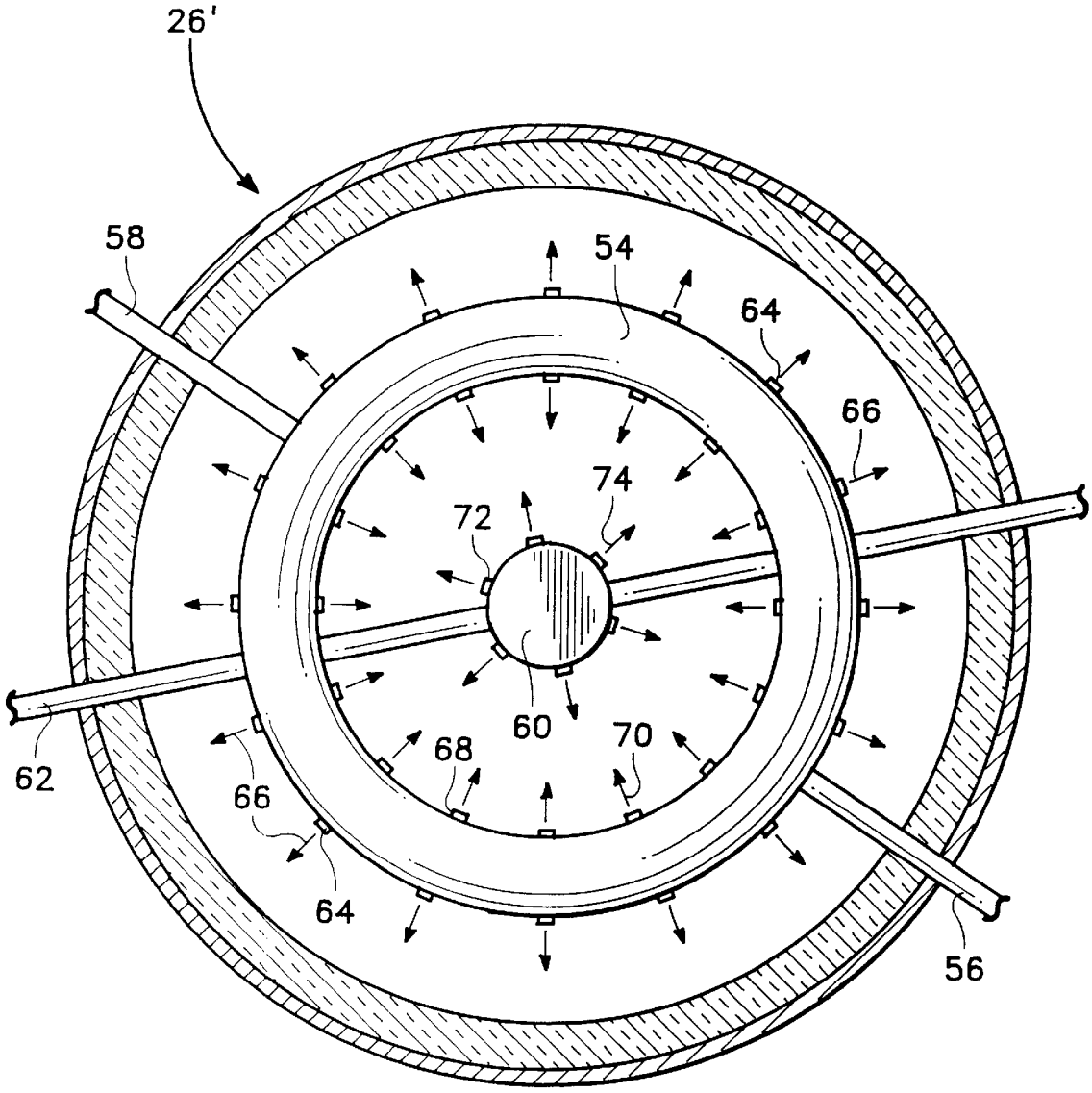
FIGS. 3A–3C are views typical of one of the two annular after-reactor temperature augmenters of the annular after reactor of FIG. 1.
Figure 3B:
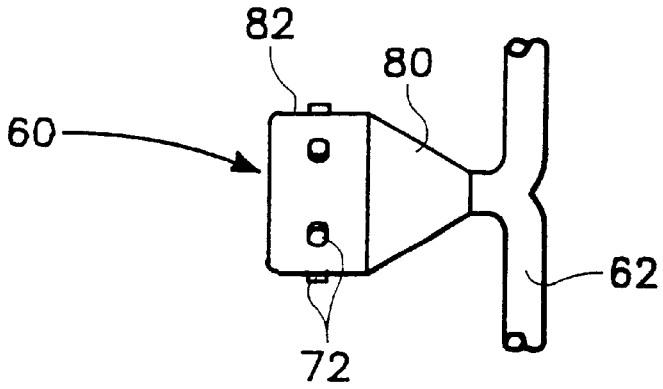

Injection ring 54 also has a plurality of equally spaced gas injection ports or nozzles 64 located around its outer circumference and a plurality of equally spaced gas injection ports or nozzles 68 located around its inner circumference. As shown in FIG. 3A, injection ring 54 includes a plurality of gas injection nozzles 64 which inject natural gas outwardly into the exhaust stream (as indicated by arrows 66) and a plurality of gas injection nozzles 68 which inject natural gas outwardly into the exhaust stream (as indicated by arrows 70).

Temperature augmenter 26' also has a centrally located gas injection device 60 which includes six equally spaced gas injection nozzles 72 (typical) positioned around its circumference to inject natural gas into the exhaust stream of jet engine 12 in the manner indicated by arrows 74. A centerpiece fuel feed line 62 is connected to device 60 supplying natural gas to device 60. Feed line 62 is also used to position device 60 centrally within augmenter 26' and to provide support for device 60. Gas injection device 62 comprises a cone shaped forward portion 80 and a cylindrical shaped forward portion 82 which includes equally spaced gas injection nozzles 72.

At this time it should be noted that the present invention may utilize only one augmenter (as shown in FIG. 3A) to raise the temperature of the jet engine's exhaust to between 1850° F. to 2200° F. which will incinerate the particulate matter in the jet engine's exhaust. As an alternative, the apparatus of the present invention may include a second augmenter of the type illustrated in FIG. 3A to inject ammonia into the exhaust from jet engine 12. Ammonia when injected into the exhaust stream for the jet engine's exhaust again functions as a reductant to eliminate up to 90% of the $NO_X$ compounds in the exhaust stream.

Figure 3C:
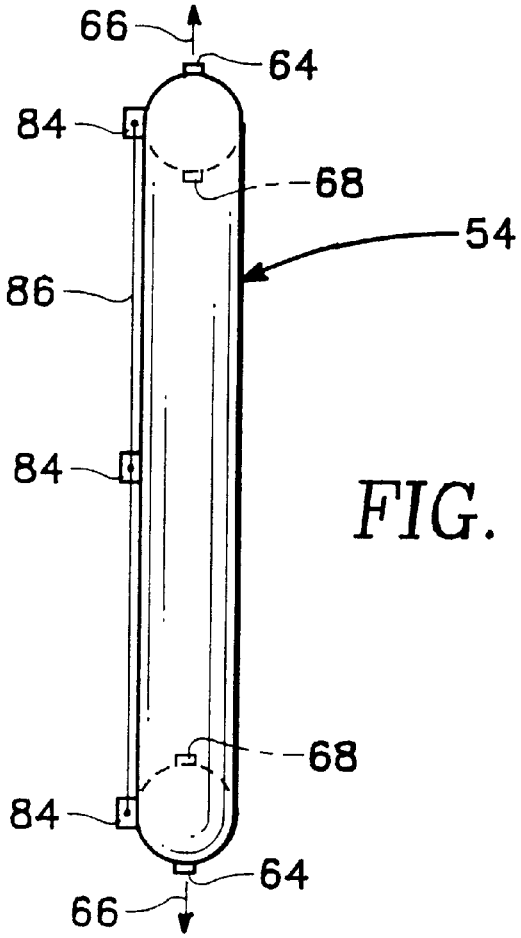

As is best illustrated in FIG. 3C, augmenter 26' may include an ignition source 86 such a heated wire to ignite the natural gas injected in the jet engine's exhaust. Support for ignition source 86 is provided by ceramic standoffs 84 mounted on the backside of tubular injection ring 54.

Figure 4:
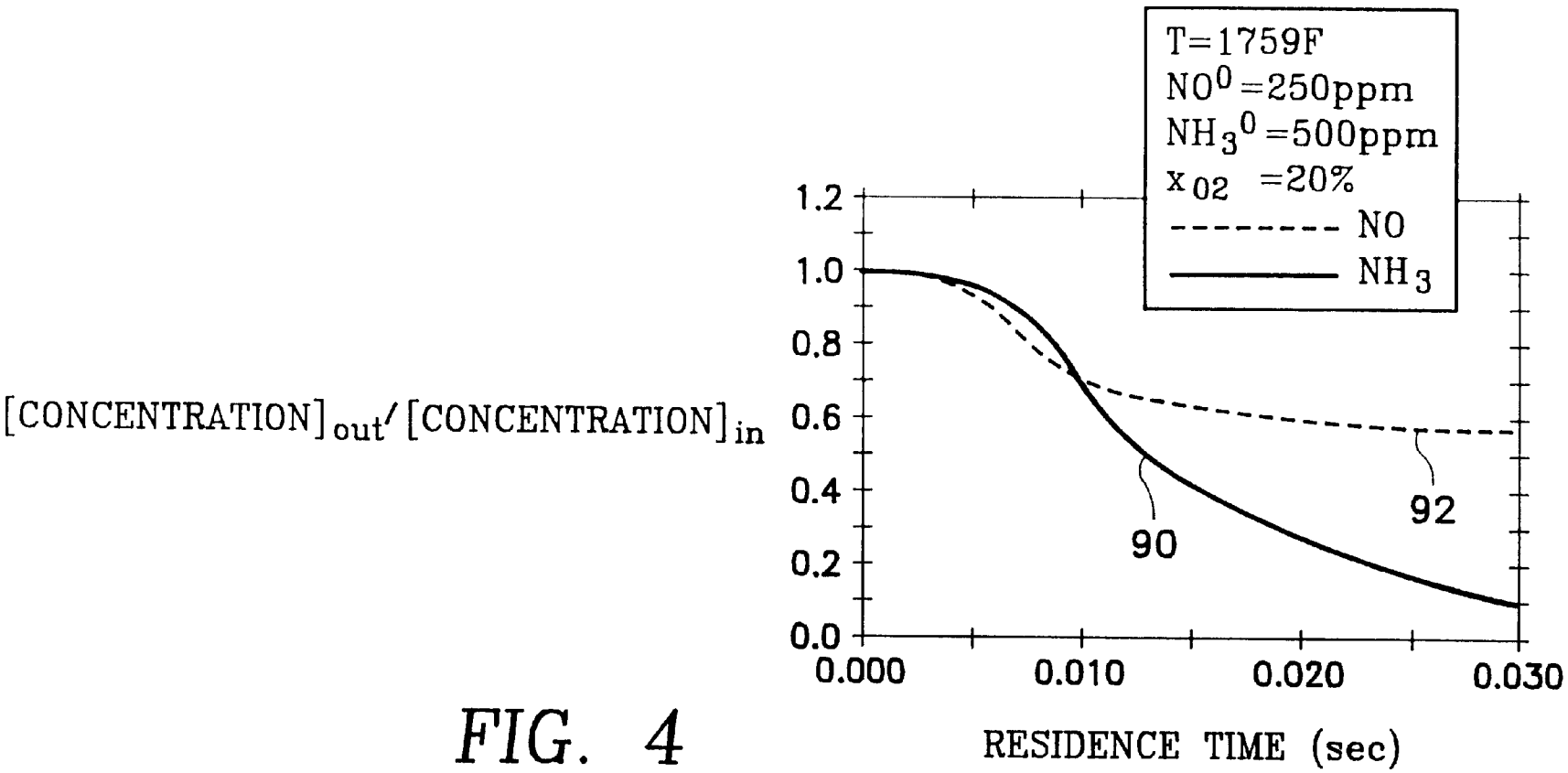
FIG. 4 illustrates plots for NO and $NO_2$ for simulated after reactor conditions for the annular after reactor of FIG. 1.

Referring to FIGS. 1 and 4, a reductant such as ammonia ($NH_3$) or related compounds (e.g., urea) may be used to reduce $NO_X$ compounds in the exhaust stream of jet engine 12. By injecting a reductant into the exhaust stream of jet engine 12 when the exhaust is in a temperature range of 1650° F. to 1850° F., $NO_X$ reductions of up to 90% can be achieved in a fraction of a second utilizing the approach defined as selective non-catalytic reduction (SNCR). FIG. 4 illustrates calculated $NO_X$ reductions using selective non-catalytic reduction in an annular after reactor 26 of the type which constitutes the present invention. As shown in FIG. 4, $NO_X$ levels is reduced by 45% in 30 ms of annular after-reactor residence time. For an annular after-reactor residence time 40–50 ms, a reduction of 50% is achievable.

Referring to FIGS. 1 and 5–9, the jet engine 12 being tested in jet engine test cell 10 will generate a substantial amount of noise, designated generally by the reference numeral 90 when exhaust is emitted from jet engine 12 (as is best indicted by arrow 92). This noise is the result of velocity fluctuations and flow instabilities in the sound medium within test cell. As these velocity fluctuations and flow instabilities grow, the intensity of the noise emitted increases substantially. Sir James Lighthill's eighth power law accurately predicts that noise from a highly turbulent jet caused by the turbulent fluctuations in the jet exhaust increases in proportion to the eighth power of the jet velocity. Any substantial attenuation of the velocity and flow instabilities will therefore result in a significant reduction in jet engine noise. Air flow into the jet engine 12 is depicted by arrow 96.

Figure 5:
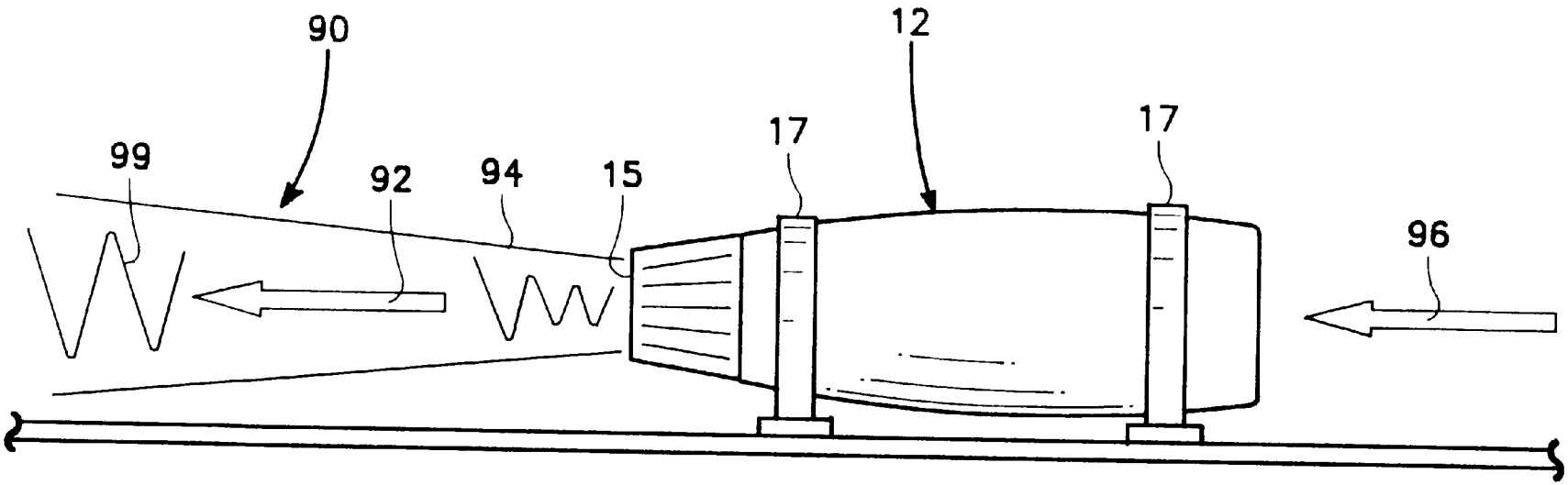
FIG. 5 illustrates jet engine noise produced in the velocity shear layer that develops between jet exhaust and the surrounding atmosphere.

As shown in FIG. 5, jet engine noise 90 is produced in the velocity shear layer 94 that develops between jet exhaust 92, the surrounding atmosphere and a core region 99 within the jet engine exhaust. At after-burner conditions, jet velocities in excess of 3000 feet per second lead to large velocity fluctuations at varying frequencies in the shear layer 94 and core region 99 which results in unacceptable noise levels 90 from jet engine exhaust.

Figure 6:
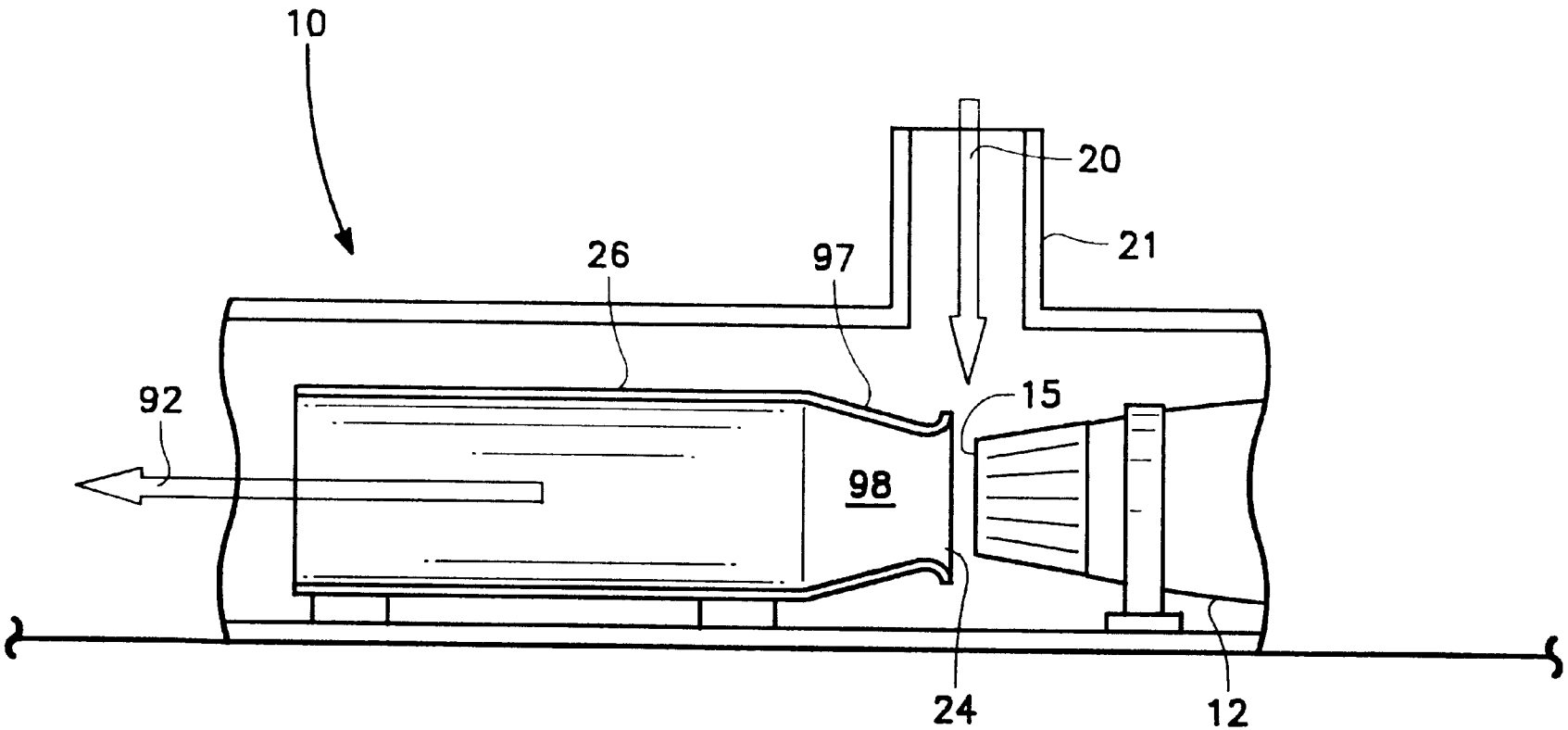
FIGS. 6, 7, 8, 9A and 9B illustrate embodiments of the present invention which reduce noise within a jet engine test cell.

Referring to FIG. 6, the inlet 24 and cone shaped portion 97 of annular after reactor 26 are shaped to function as a diffuser 98. Diffuser 98 intercepts the jet engine exhaust 92 generated by jet engine 12 preventing the formation of a substantial portion of the shear layer 94 (FIG. 5) that normally forms when a jet engine is being tested. Diffuser 98 slows jet exhaust flow by transforming high velocity exhaust into a lower velocity gas flow exiting diffuser 98.

The aerodynamic design of inlet 24 and the cone shaped portion 97 of annular after reactor 26 substantially reduce noise levels. In addition, air flow (indicated by arrow 20) through vertically positioned air intake port 21 provides additional air to the diffuser 98 further reducing velocity fluctuations which also limits noise caused by jet engine exhaust.

Figure 7:
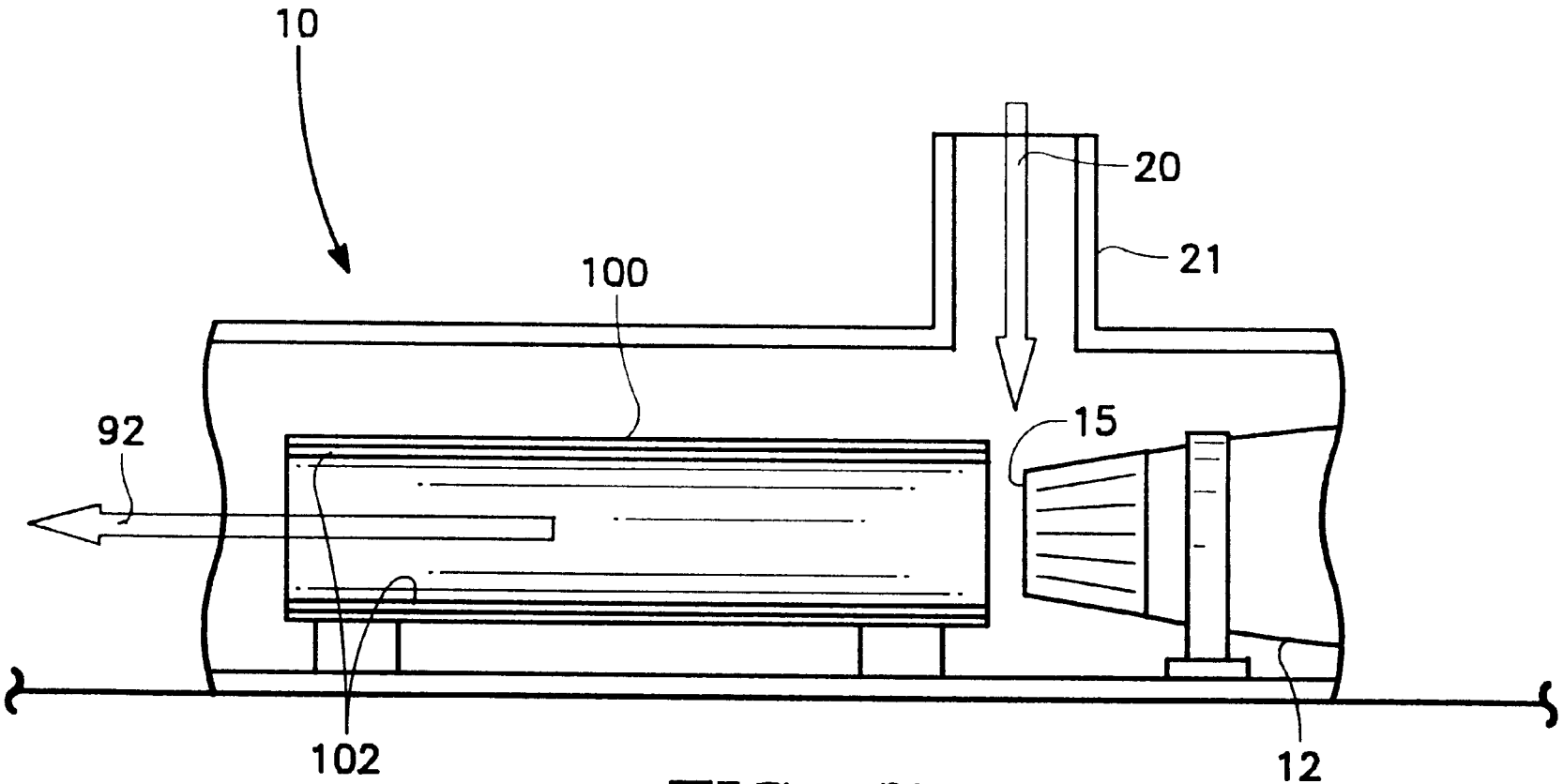

Referring now to FIG. 7, slowing of jet engine exhaust velocity can also be achieved with a cylindrical shaped annular after reactor 100. While the cylindrical shape of reactor 100 will reduce noise caused by jet engine exhaust, the reduction is not to the level of noise reduction provided by the reactor design illustrated in FIG. 6. To further reduce noise in the annular after reactor 100 illustrated in FIG. 7, a layer of an acoustic insulating material 102 may be affixed to the inner surface of reactor 100. A layer of an acoustic insulating material could also be attached to the inner surface of the annular after reactor 26 illustrated in FIG. 6 to reduce jet engine exhaust noise.

Figure 8:
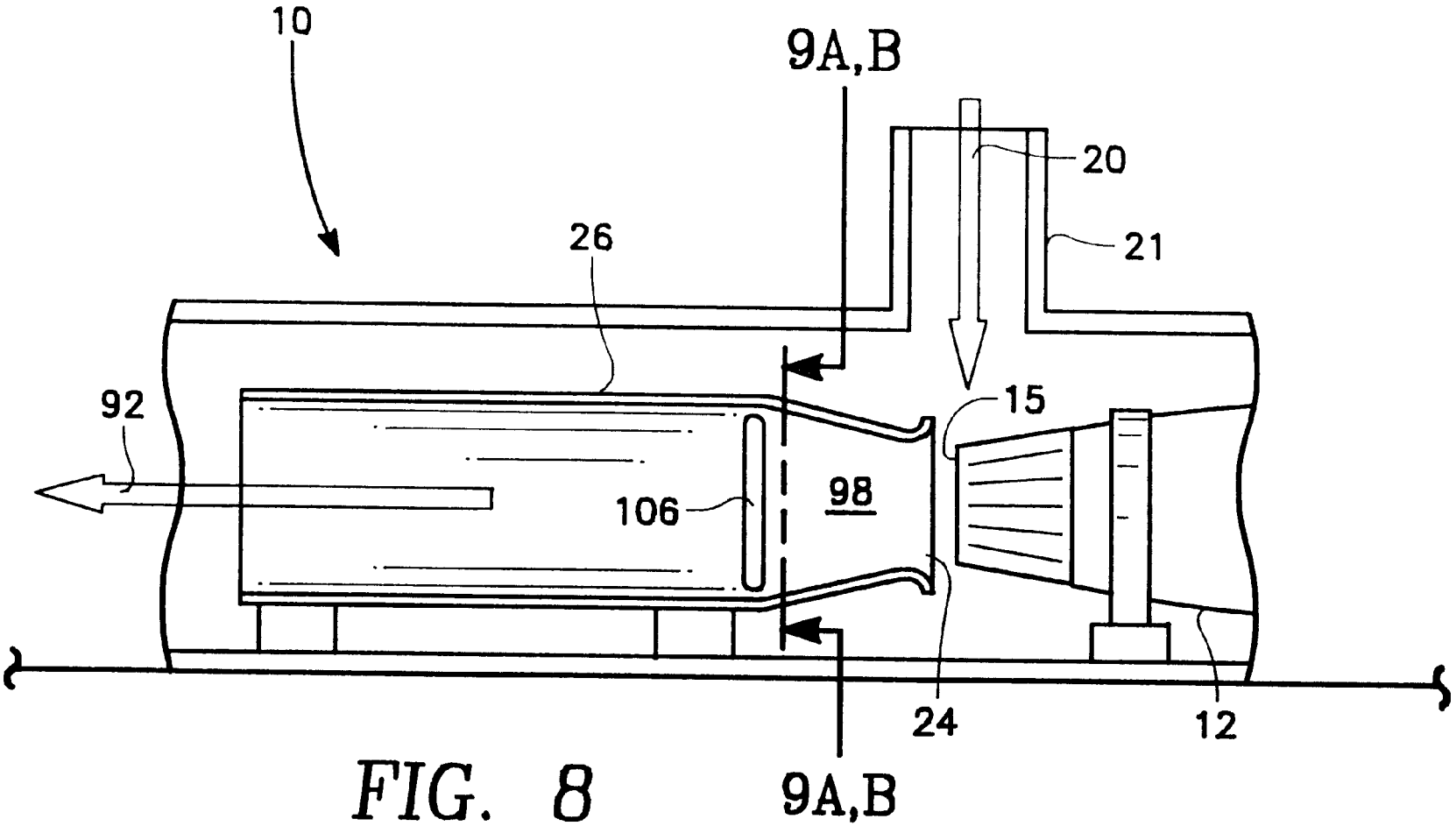
Figure 9A:
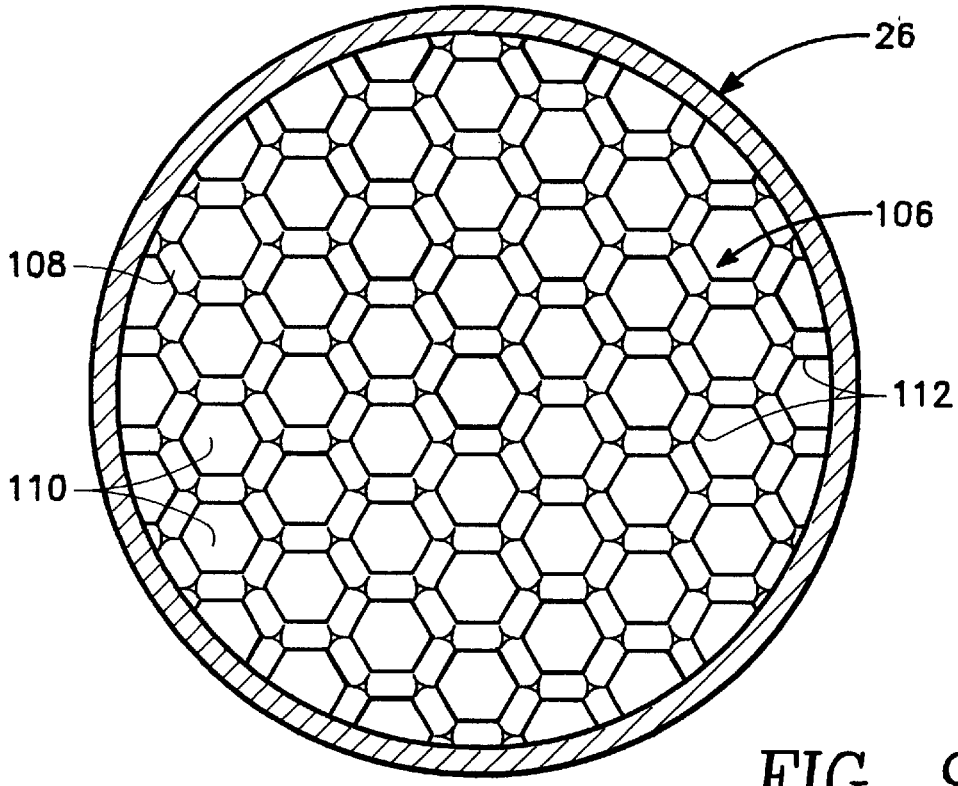
Figure 9B:
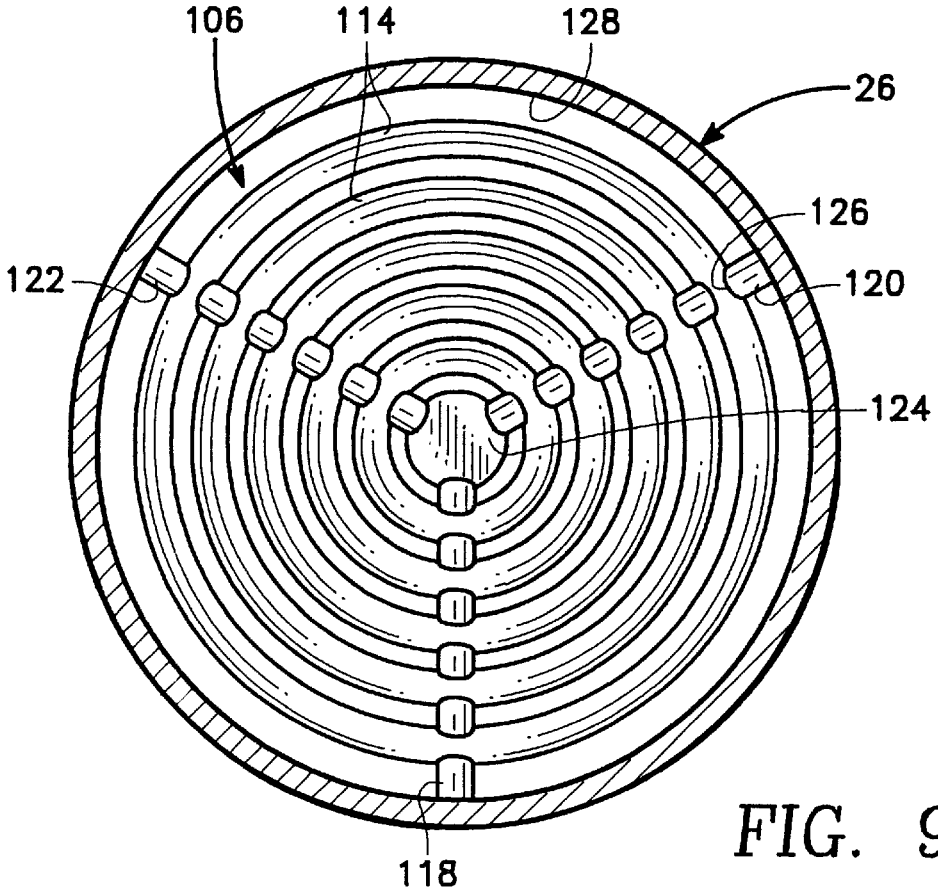

Referring now to FIGS. 8, 9A and 9B, annular after reactor 26 may include a jet engine exhaust buster assembly 106 vertically positioned in a forward portion of reactor 26 behind diffuser 98. As shown in FIG. 9A, assembly 106 may comprise a honeycomb structure 108 having a plurality of openings 110 through which jet exhaust pass. Each opening 110 has an interior surface 112 which approximates a circle having a diameter of between one and three inches. As shown in FIG. 9B, assembly 106 may also comprise a plurality of concentric rings 114 and a support structure which includes support rods 118, 120 and 122 which join at a centrally located support hub 124. The support rods 118, 120 and 122 are spaced apart from one another by 120°, pass through openings 126 in each the concentric rings 114 and have one end attached to the interior surface 128 of annular after reactor 26 and the opposite end attached to support hub 124. The interior surface 128 may be the interior surface of the ceramic material 48 illustrated in FIG. 2 or it may be the interior surface of the outer casing 46 also illustrated in FIG. 2.

The jet engine exhaust buster assemblies 106 illustrated in FIGS. 9A and 9B operate to break up jet engine exhaust, lowering velocity gas flow which exits diffuser 98. This reduction in velocity, in turn, substantially reduces noise levels within jet engine test cell 10.

Sound measurements have shown noise reductions of up to 15 Db with annular after reactor 10 using an aerodynamically designed diffuser like diffuser 98.

From the foregoing, it may readily be seen that the present invention comprises a new, unique and exceedingly useful annular after reactor for use with a jet engine test cell and test stand which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. An apparatus for removing particulate matter and nitrogen oxides from an exhaust stream generated by a jet engine under test, said apparatus comprising:

an annular after reactor aligned axially with a direction of exhaust flow from an exhaust port of said jet engine, said annular after reactor having a cylindrical shaped outer casing, and an interior;

first injecting means located within the interior of said annular after reactor for injecting natural gas into said exhaust stream to remove said particulate matter from said exhaust stream when a temperature for said exhaust stream is raised to a first temperature range;

igniting means positioned adjacent said first injecting means to ignite said natural gas injected into said exhaust stream raising the temperature of said exhaust stream to said first temperature range which removes said particulate matter from said exhaust stream; and second injecting means located within the interior of said annular after reactor downstream from said first injecting means, said second injecting means injecting ammonia into said exhaust stream to remove said nitrogen oxides from said exhaust stream when the temperature of said exhaust stream is within a second temperature range; and sound attenuating means positioned within said annular after reactor for substantially reducing noise levels within said annular after reactor.

2. The apparatus of claim 1 wherein said first and second injecting means each comprise a set of spoke shaped injectors positioned perpendicular to said cylindrical shaped outer casing, each set of said spoke shaped injectors extending inward into the interior of said annular after reactor.

3. The apparatus of claim 1 wherein said first temperature range comprises a temperature range of 1850° F. to 2200° F.

4. The apparatus of claim 1 wherein said second temperature range comprises a temperature range of 1650° F. to 1850° F.

5. The apparatus of claim 1 further comprising a layer of ceramic material positioned inside of said cylindrical shaped outer casing, said layer of ceramic material being affixed to said cylindrical shaped outer casing.

6. The apparatus of claim 1 wherein said first and second injecting means each comprise:

a tubular gas injection ring vertically positioned within the interior of said annular after reactor;

first and second fuel feed lines connected to said tubular gas injection ring, said first and second fuel feed lines providing support for said tubular gas injection ring;

said tubular gas injection ring having a first plurality of equally spaced gas injection nozzles located around an outer circumference thereof and a second plurality of equally spaced gas injection nozzles located around an inner circumference thereof;

a centrally located gas injection device positioned within the interior of said annular after reactor, said gas injection device being aligned with said tubular gas injection ring;

said gas injection device having six equally spaced gas injection nozzles positioned around the circumference thereof; and a third fuel feed line connected to said gas injector device, said third fuel feed line being used to position said gas injection device centrally within the interior of said annular after reactor and to provide support for said gas injection device.

7. The apparatus of claim 1 wherein said sound attenuating means comprises a honeycomb structure positioned within the interior of said annular after reactor, said honeycomb structure having a plurality of openings through which said exhaust stream passes, each of said plurality of openings having an interior surface which approximates a circle having a diameter of between one inch and three inches.

8. The apparatus of claim 1 wherein said sound attenuating means comprises:

a plurality of concentric rings vertically positioned within the interior of said annular after reactor; and a support structure having a centrally located support hub and a plurality of equally spaced apart support rods affixed to each of said concentric rings, one end of each of said support rods being attached to said support hub and the opposite end of each of said support rods being attached to an interior surface of said annular after reactor.

9. The apparatus of claim 1 further comprising a layer of an acoustic insulating material affixed to an interior surface of said annular after reactor.

10. The apparatus of claim 1 wherein said sound attenuating means reduces said noise levels by approximately fifteen decibels.

11. An apparatus for removing particulate matter and nitrogen oxides from an exhaust stream generated by a jet engine under test, said apparatus comprising:

an annular after reactor aligned axially with a direction of exhaust flow from an exhaust port of said jet engine, said annular after reactor having a cylindrical shaped outer casing, and an interior;

a layer of ceramic material positioned inside of said cylindrical shaped outer casing, said layer of ceramic material being affixed to said cylindrical shaped outer casing;

a first gas injector located within the interior of said annular after reactor for injecting natural gas into said exhaust stream to remove said particulate matter from said exhaust stream when a temperature for said exhaust stream is raised to a first temperature range of 1850° F. to 2200° F.;

a gas ignition device positioned adjacent said first gas injector to ignite said natural gas injected into said exhaust stream raising the temperature of said exhaust stream to said first temperature range to remove said particulate matter from said exhaust stream; and a second gas injector located within the interior of said annular after reactor downstream from said first gas injector, said second gas injector injecting ammonia into said exhaust stream to remove said nitrogen oxides from said exhaust stream when the temperature of said exhaust stream is within a second temperature range of 1650° F. to 1850° F.;

a diffuser positioned at the front end of said annular after reactor, said diffuser being aligned axially with the direction of exhaust flow from an exhaust port of said jet engine; and a jet engine exhaust buster assembly positioned in a forward portion of said annular after reactor, said jet engine exhaust buster assembly being aligned axially with the direction of exhaust flow from an exhaust port of said jet engine;

said diffuser and said jet engine exhaust buster operating in combination to substantially reduce noise levels within said annular after reactor.

12. The apparatus of claim 11 wherein said first and second gas injectors each comprise a set of spoke shaped injectors positioned perpendicular to said cylindrical shaped outer casing, each set of said spoke shaped injectors extending inward into the interior of said annular after reactor.

13. The apparatus of claim 11 wherein said first and second gas injectors each comprise:

a tubular gas injection ring vertically positioned within the interior of said annular after reactor;

first and second fuel feed lines connected to said tubular gas injection ring, said first and second fuel feed lines providing support for said tubular gas injection ring;

said tubular gas injection ring having a first plurality of equally spaced gas injection nozzles located around an outer circumference thereof and a second plurality of equally spaced gas injection nozzles located around an inner circumference thereof;

a centrally located gas injection device positioned within the interior of said annular after reactor, said gas injection device being aligned with said tubular gas injection ring;

said gas injection device having six equally spaced gas injection nozzles positioned around the circumference thereof; and a third fuel feed line connected to said gas injector device, said third fuel feed line being used to position said gas injection device centrally within the interior of said annular after reactor and to provide support for said gas injection device.

14. The apparatus of claim 11 wherein said gas ignition device comprises a heated wire.

15. The apparatus of claim 11 wherein said jet engine exhaust buster assembly comprises a honeycomb structure having a plurality of openings through which said exhaust stream passes, each of said plurality of openings having an interior surface which approximates a circle having a diameter of between one inch and three inches.

16. The apparatus of claim 11 wherein said jet engine exhaust buster assembly comprises:

a plurality of concentric rings vertically positioned within the interior of said annular after reactor; and a support structure having a centrally located support hub and a plurality of equally spaced apart support rods affixed to each of said concentric rings, one end of each of said support rods being attached to said support hub and the opposite end of each of said support rods being attached to an interior surface of said annular after reactor.

17. The apparatus of claim 11 further comprising a layer of an acoustic insulating material affixed to an interior surface of said annular after reactor.

18. The apparatus of claim 11 wherein said diffuser and said jet engine exhaust buster operating in combination reduce said noise levels by approximately fifteen decibels.

19. An apparatus for removing particulate matter from an exhaust stream generated by a jet engine under test, said apparatus comprising:

an annular after reactor aligned axially with a direction of exhaust flow from an exhaust port of said jet engine, said annular after reactor having a cylindrical shaped outer casing, and an interior;

a layer of ceramic material positioned inside of said cylindrical shaped outer casing, said layer of ceramic material being affixed to said cylindrical shaped outer casing;

a gas injector located within the interior of said annular after reactor for injecting natural gas into said exhaust stream to remove said particulate matter from said exhaust stream when a temperature for said exhaust stream is raised to a temperature range of 1850° F. to 2200° F.;

a gas ignition device positioned adjacent said first gas injector to ignite said natural gas injected into said exhaust stream raising the temperature of said exhaust stream to said first temperature range to remove said particulate matter from said exhaust stream;

a diffuser positioned at the front end of said annular after reactor, said diffuser being aligned axially with the direction of exhaust flow from an exhaust port of said jet engine; and a jet engine exhaust buster assembly positioned in a forward portion of said annular after reactor, said jet engine exhaust buster assembly being aligned axially with the direction of exhaust flow from an exhaust port of said jet engine;

said jet engine exhaust buster assembly comprising a honeycomb structure having a plurality of openings through which said exhaust stream passes, each of said plurality of openings having an interior surface which approximates a circle having a diameter of between one inch and three inches;

said diffuser and said jet engine exhaust buster operating in combination to substantially reduce noise levels within said annular after reactor.

20. The apparatus of claim 19 wherein said gas injector comprises a set of spoke shaped injectors positioned perpendicular to said cylindrical shaped outer casing, said set of spoke shaped injectors extending inward into the interior of said annular after reactor.

21. The apparatus of claim 19 wherein said gas injector comprises:

a tubular gas injection ring vertically positioned within the interior of said annular after reactor;

first and second fuel feed lines connected to said tubular gas injection ring, said first and second fuel feed lines providing support for said tubular gas injection ring;

said tubular gas injection ring having a first plurality of equally spaced gas injection nozzles located around an outer circumference thereof and a second plurality of equally spaced gas injection nozzles located around an inner circumference thereof;

a centrally located gas injection device positioned within the interior of said annular after reactor, said gas injection device being aligned with said tubular gas injection ring;

said gas injection device having six equally spaced gas injection nozzles positioned around the circumference thereof; and a third fuel feed line connected to said gas injector device, said third fuel feed line being used to position said gas injection device centrally within the interior of said annular after reactor and to provide support for said gas injection device.

22. The apparatus of claim 19 wherein said gas ignition device comprises a heated wire.

23. The apparatus of claim 19 wherein said diffuser and said jet engine exhaust buster operating in combination reduce said noise levels by approximately fifteen decibels.

* * * * *